United States Patent [19]

Counselor et al.

[11] 4,298,049

[45] Nov. 3, 1981

[54] METHOD FOR ASSEMBLING MOLDS

[75] Inventors: Gary D. Counselor; Robert C. Gerst; Reginald A. Pennington, all of Muskegon, Mich.

[73] Assignee: Westran Corporation, Muskegon, Mich.

[21] Appl. No.: 67,378

[22] Filed: Aug. 17, 1979

[51] Int. Cl.[3] ..... B22C 9/10; B22C 9/24

[52] U.S. Cl. ..... 164/30; 164/137; 164/340; 164/365

[58] Field of Search ..... 164/137, 351, 365, 368, 164/369, 370, 397, 332, 30, 31, 32; 249/94, 96

[56] References Cited

U.S. PATENT DOCUMENTS

| | | | |
|---|---|---|---|
| 991,258 | 5/1911 | Woods | 164/32 |
| 1,384,438 | 7/1921 | Edwards | 164/137 |
| 1,657,444 | 1/1928 | Prince | 164/30 |
| 1,684,715 | 9/1928 | Ryan | 164/366 |
| 2,845,669 | 8/1958 | Hackett et al. | 164/361 X |
| 3,517,729 | 6/1970 | Wonus | 164/332 X |
| 3,580,329 | 5/1971 | Taccone | 164/366 |

*Primary Examiner*—R. L. Spruill
*Assistant Examiner*—Gus T. Hampilos
*Attorney, Agent, or Firm*—Gifford, VanOphem, Sheridan & Sprinkle

[57] ABSTRACT

A novel casting method is provided which includes a shell mold having a cope and a drag, which abut together along substantially planar mating surfaces and define a casting cavity between the cope and drag. At least one core is positioned within the casting cavity and includes at least one and preferably two crush pads each having a cam surface. As the cope is positioned onto the drag, the cope engages the crush pad cam surfaces and cams the core flatly against the shell mold.

6 Claims, 4 Drawing Figures

METHOD FOR ASSEMBLING MOLDS

BACKGROUND OF THE INVENTION

1. Field of the Invention

The present invention relates generally to a method for casting and, more particularly, to an improved shell mold assembly.

2. Description of the Prior Art

In shell mold casting, the shell mold comprises two sections, the cope and drag, which abut together along substantially planar mating surfaces. With the cope and drag mating surfaces in abutment with each other, the cope and drag define the casting cavity of the part which is to be formed.

The cope and drag are typically made from a dry mixture of silica or other refractory oxide sand and a minor amount of plastic or resin binder. The dry mixture of molding sand is then applied to a hot casting pattern for a relatively short period of time which melts the binder and bonds the sand together to accurately reproduce the details of the casting pattern. The cope and drag are thereafter secured together along their mating surfaces and molten metal is introduced into the casting pattern through a sprue to form the desired part.

One previously unsolved problem with shell mold casting has been the formation of openings in the casting which extend in a direction other than substantially normal to the mating surfaces of the cope and drag and particularly openings through the casting which extend substantially parallel to the cope and drag mating surfaces. Such openings cannot be formed in the cope or drag by the casting pattern since, to do so, would bond the shell mold to the casting pattern and render it impossible to remove the shell mold without breaking it.

As a result of the above described limitations of shell mold casting, it has been the previous practice to machine the desired openings in the casting which are not normal to the mating surfaces after the casting has been removed from the shell mold. The subsequent machining of the casting, however, is expensive both in machine and labor costs which accordingly increases the overall price of the final part.

SUMMARY OF THE PRESENT INVENTION

The present invention overcomes these above mentioned disadvantages by providing a unique casting method by which openings in the casting which are non-normal to the mating surfaces of the cope and drag can be formed during the casting operation.

In brief, the present invention comprises a shell mold having a cope and drag which abut together along substantially planar mating surfaces formed respectively on the cope and drag. Upon the abutment of the cope and drag mating surfaces, the cope and drag define a casting cavity therebetween.

At least one core, which can be a shell core, is positioned within the casting cavity and includes at least one outwardly extending protrusion which extends in a direction non-normal to the cope and drag mating surfaces. In the preferred form of the invention, the core protrusion extends substantially parallel to the cope and drag mating surfaces.

In order to both accurately position the core within the casting cavity and to also prevent undesired molten metal leakage between the shell mold and the core, the core includes one or more crush pads each having a cam surface formed on the area which enters the upper or cope half of the shell mold. As the cope is placed over the drag, the cope engages the crush pad cam surfaces to provide normal draft and urge the core firmly and flatly against the shell mold. This camming of the core also eliminates all scrubbing action between the core protrusions and the shell mold during close up of the shell mold.

Molten metal is then introduced into the casting cavity while the core protrusion forms the desired opening in the casting which is non-normal with respect to the cope and drag mating surfaces.

BRIEF DESCRIPTION OF THE DRAWINGS

A better understanding of the present invention will be had upon reference to the following detailed description when read in conjunction with the accompanying drawing, wherein like reference characters refer to like parts throughout the several views, and in which.

DETAILED DESCRIPTION OF THE PRESENT INVENTION

Figure 3:
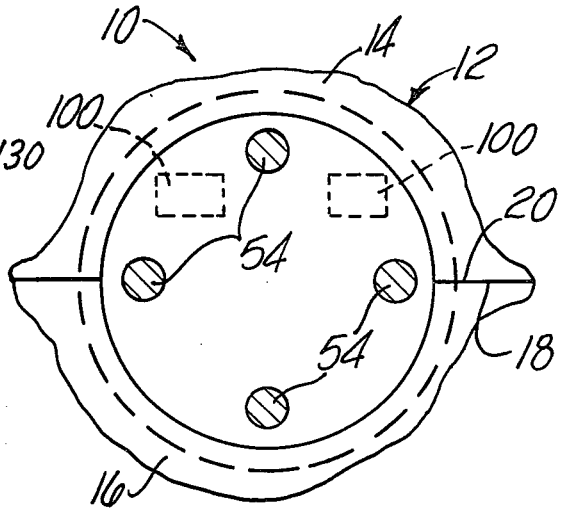
FIG. 3 is a sectional view of the casting apparatus of the present invention and taken substantially along line 3—3 in FIG. 2.
Figure 2:
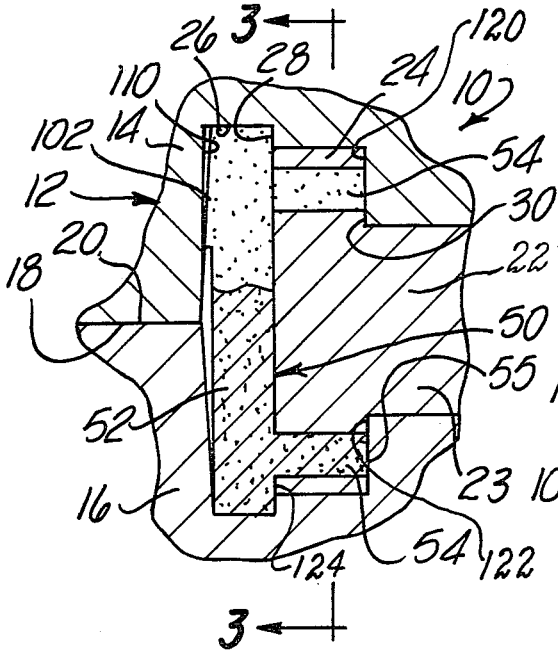
FIG. 2 is a fragmentary longitudinal sectional view illustrating the casting apparatus of the present invention with the shell mold closed.
Figure 4:
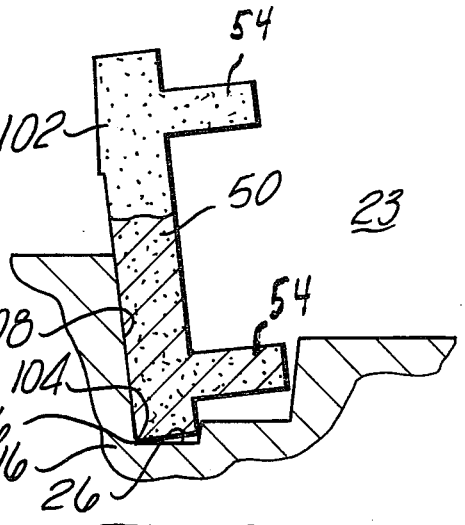
FIG. 4 is a fragmentary sectional view illustrating the casting apparatus of the present invention with the shell mold open.

With reference first to FIGS. 2 and 3, the casting apparatus 10 of the present invention is thereshown and comprises a shell mold 12 having an upper core 14 and a lower drag 16. The cope 14 and drag 16 are preferably formed by casting a dry mixture of refractory oxide sand and a minor amount of plastic or resin binder onto a casting pattern in the conventional fashion. Moreover, only the left half of the shell mold 12 is illustrated in FIGS. 2 and 4 since the right half of the shell mold is substantially the same.

The cope 14 includes a lower mating surface 18 which registers with and flatly abuts against a similar mating surface 20 formed on the upper side of the drag 16 when the shell mold is closed. The mating surfaces 20 and 18 are substantially planar as shown in the drawing. In addition, upon the abutment of the mating surfaces 20 and 18 together, the cope 14 and drag 16 form a casting cavity 22 therebetween.

Still referring to FIGS. 2 and 3, the casting cavity 22 includes a central cylindrical portion 23 having a first enlarged diameter portion 24 and also may have a second still larger enlarged diameter portion 26 at one axial end of the cavity 22. The junction of the large diameter portions 24 and 26 forms an annular and radially extending first abutment surface 28 therebetween while, similarly, the junction of the inner enlarged diameter portion 24 and the central portion 23 of the casting cavity 22 forms a second annular abutment surface 30.

The casting apparatus 10 according to the present invention further includes a core 50 having disc-shaped body 52 with an outer diameter slightly larger than the enlarged diameter portion 26 of the casting cavity 22. The core 50 further includes four circumferentially spaced protrusions 54 which extend axially outwardly from the core disc 52. The protrusions 54 are cylindrical in cross-sectional shape and their axial length is exactly the same as the width of the enlarged diameter portion 24 of the cavity 22 in the example shown.

Still referring to FIGS. 2 and 3, the core 50 further includes a pair of spaced apart crush pads 100 along its upper or cope half. Each pad 100 includes a cam or tapered surface 102 (FIG. 2) which tapers outwardly from the top of the pad 100 and provides normal draft for the core relative to the shell mold parting line as will be shortly described.

Referring now to FIG. 4 with the cope 14 removed from the drag 16, the core 50 is positioned within the enlarged diameter portion 26 of the shell mold 12 so that its protrusions 54 extend axially toward the central portion 23 of the casting cavity 22. A locator surface 104 in the drag 16 abuts against the lower outside corner 106 of the core 50 to position the core 50 within portion 26. Moreover, an end surface 108 of the drag 16 tapers outwardly from the locator surface 104 so that the core 50 tilts due to its weight against the surface 108 and away from the casting cavity 22.

Referring now to FIG. 2, as the cope 14 is positioned onto the drag 16, a cooperating surface 110 on the cope 12 engages the crush pad surfaces 102 on the first core 50 and cams the core 50 around the location surface 104 and axially inwardly toward the central portion 23 of the casting cavity 22. This camming action thus urges the free ends 55 of the core protrusions 54 flatly against the annular abutment surface 30 and simultaneously urges the outer periphery of the core disc 52 flatly against the annular abutment surface 28. The camming action of the core 50 also eliminates all scrubbing action between the ends 55 of the protrusions 54 and the shell mold 12.

With the cope 14 and drag 16 secured together by means not shown, the casting cavity 52 is invested with the casting material, typically molten metal, which fills the volume between the cope 14, drag 16 and the core 50. Due to the previously described camming action between the shell mold 12 and the core 50, undesirable metal leakage past the free ends 55 of the protrusions 54 and likewise around the shell core 50 is totally prevented. During investment, the metal disintegrates the shell mold adjacent to the casting due to burn off of the resin binder.

Figure 1:
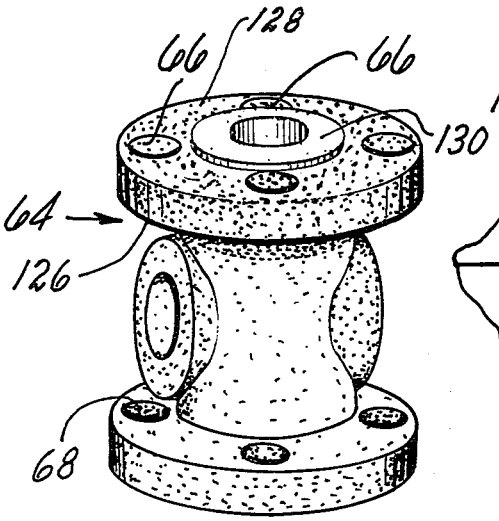
FIG. 1 is a perspective view illustrating a part formed by the casting apparatus of the present invention.

After the molten metal is cooled, the formed part 64 (FIG. 1) is removed from the shell mold 12 and from the core 50. As can be seen in FIG. 1, the core protrusions form openings 66 through the part 64 which are generally parallel to the parting line of the cope and drag mating surfaces 18 and 20. Consequently, the previously required machining to form the opening holes 66 and 68 through the part 64 following the casting operation is completely obviated by the casting apparatus 10 of the present invention.

It can, therefore, be seen that the casting apparatus 10 of the present invention provides a simple and relatively inexpensive device for casting by which openings which are non-normal to the mating surfaces 18 and 20, respectively, of the cope and drag can be formed during the casting operation. Consequently, the apparatus 10 according to the present invention eliminates much of the previously required subsequent machining on the cast part 64. In particular due to the camming action of the core 50, the surfaces 120 and 122 on the cope 14 and drag 16, respectively, and also the surface 124 on the core can be constructed with substantially zero radial draft. Because of this, the flange surfaces 126 and 128 (FIG. 1) on the cast part 64 require no additional machining except for a gasket seat 130 on the cast part 64.

Elimination of the subsequent machining, of course, eliminates the associated machine, material and labor costs required by such machining. Moreover, the formation of the openings 66 and 68, respectively, during the casting process also reduces the amount of casting material required during the casting operation and thus reduces the material cost of the cast part 64. Previously, the material machined from the cast part 64 has been wastefully discarded.

Having described my invention, however, many modifications thereto will become apparent to those skilled in the art to which it pertains without deviation from the spirit of the invention as defined by the scope of the appended claims.

We claim:

1. A method for assembling molds comprising: providing a mold comprising a cope and a drag, said cope and said drag having mating surfaces which abut together and define a casting cavity between the cope and the drag; providing a core carried by said cope and said drag and positioned within said cavity, said core including at least one elongated protrusion extending into said cavity in a direction substantially parallel to the mating surfaces of said cope and said drag whereby said protrusion forms an opening in the casting with an axis extending in a direction substantially parallel to the mating surfaces of said cope and said drag, providing said cope and said drag with end surfaces defining portions of said cavity and extending substantially normal to said mating surfaces, providing said drag with casting cavity surfaces defining a locator corner against which an edge of said core is adapted to abut, providing a cam surface on said core, positioning said core in said drag such that an edge of said core abuts said locator corner and such that said core is in a position displaced from a proper position for casting, and engaging said cam surface with an end surface by moving said mating surfaces into mating relation to pivot said core about said locator corner thereby moving said core from said displaced position to said casting position whereby the longitudinal axis of said protrusion is substantially parallel to the mating surfaces of said cope and said drag to thereby properly position a hole to be formed in said casting.

2. The method as defined in claim 1 and including a recess formed in said cope and said drag to receive said core, said recess being formed by an inner annular surface and an outer annular surface, the engagement between said end surface and said cam surface being operable to urge said core tightly against said inner annular surface.

3. The method is defined in claim 1 and wherein the axis of said protrusion is spaced from said mating surfaces.

4. A method for assembling molds comprising: providing a mold comprising a cope and a drag, said cope and said drag having mating surfaces which abut together and define a casting cavity between the cope and the drag; providing a core carried by said cope and said drag and positioned within said cavity, said core including at least one elongated protrusion extending into said cavity in a direction substantially parallel to the mating surface of said cope and said drag whereby said protrusion forms an opening in the casting with an axis extending in a direction substantially parallel to the mating surfaces of said cope and said drag, providing said cope and said drag with annular end surfaces and inner annular surfaces spaced inwardly into said cavity from said end surfaces, said protrusion having a free end disposed within said cavity, providing said drag with casting cavity surfaces defining a locator corner against which an edge of said core is adapted to abut, providing a cam surface on said core, positioning said core in said drag such that an edge of said core abuts said locator corner and such that said core is in a position displaced from a proper position for casting, and engaging said cam surface with an annular end surface by moving said mating surfaces into mating relation to pivot said core about said locator corner thereby moving and core from said displaced position to said casting position whereby the free end of said protrusion is tightly against said inner annular surface.

5. A method as defined in claims 1 or 4 wherein said core includes at least one crush pad and wherein said cam surface is formed on said at least one crush pad.

6. A method for assembling molds comprising: providing a shell mold comprising a cope and a drag, said cope and said drag having mating surfaces which abut together and define a casting cavity between the cope and the drag; providing a core positioned within said casting cavity; providing camming means for urging said core into a casting position as the cope is positioned onto said drag so that the mating surfaces of the cope and drag abut together, providing said cope and said drag with surfaces defining said casting cavity, providing said drag with casting cavity surfaces defining a locator corner against which an edge of said core is adapted to about, at least one of said surfaces defining said locator corner tapering away from said core when in said casting position, positioning said core in said drag such that an edge of said core abuts said locator corner and such that said core is in a position displaced from said casting position, engaging said cam surface with a casting cavity surface by moving said mating surfaces into mating relation to pivot said core about said locator corner thereby moving said core from said displaced position to said casting position.

* * * * *